United States Patent [19]

Portz et al.

[11] Patent Number: 4,775,427

[45] Date of Patent: Oct. 4, 1988

[54] PHOSPHATE CONVERSION COATINGS FOR COMPOSITE METALS

[75] Inventors: Heinz Portz, Buchen/Goetzingen; Horst-Peter Geimer, Frechen, both of Fed. Rep. of Germany

[73] Assignee: Gerhard Collardin GmbH, Cologne, Fed. Rep. of Germany

[21] Appl. No.: 97,781

[22] Filed: Sep. 17, 1987

[30] Foreign Application Priority Data

Sep. 18, 1986 [DE] Fed. Rep. of Germany ..... 3631667

[51] Int. Cl.[4] ..... C23C 22/33

[52] U.S. Cl. ..... 148/6.16; 148/6.15 Z

[58] Field of Search ..... 148/6.2, 6.16, 6.15 Z

[56] References Cited

U.S. PATENT DOCUMENTS

| | | | |
|---|---|---|---|
| 3,248,249 | 4/1966 | Collins | 148/6.16 |
| 3,272,663 | 9/1966 | Ramstein | 148/6.16 |
| 4,146,410 | 3/1979 | Reinhold | 148/6.2 |
| 4,169,741 | 10/1979 | Lampatzer | 148/6.15 Z |
| 4,264,378 | 4/1981 | Oppen | 148/6.15 Z |
| 4,680,064 | 7/1987 | Portz et al. | 148/617 |

FOREIGN PATENT DOCUMENTS

| | | |
|---|---|---|
| 134895 | 5/1984 | European Pat. Off. . |
| 5518532 | 7/1978 | Japan . |
| 5729581 | 7/1980 | Japan . |
| 840199 | 5/1979 | U.S.S.R. . |

*Primary Examiner*—Sam Silverberg

*Attorney, Agent, or Firm*—Ernest G. Szoke; Henry E. Millson, Jr.; Real J. Grandmaison

[57] ABSTRACT

A process for forming a protective coating for protecting a substrate metal from corrosion and improving the adhesion of subsequently applied coatings, comprising treating the metal with an aqueous acidic solution containing molybdate in an amount of from 0.01 to 10.0 g/l, chromium in an amount of from 0.01 to 10.0 g/l, fluoride in an amount of from 0.01 to 10.0 g/l, phosphate in an amount of from 0.01 to 10.0 g/l, zinc in an amount of from 0.005 to 1.0 g/l, and acetate in an amount of from 0.01 to 10.0 g/l. The process successfully treats a variety of metals, and provides high-quality coated composites.

26 Claims, No Drawings

PHOSPHATE CONVERSION COATINGS FOR COMPOSITE METALS

BACKGROUND OF THE INVENTION

1. Field of the Invention

The invention relates to a process for forming a protective coating on composite metals of the type generally referred to in the art as "phosphate conversion coatings." The coating layer protects the underlying metal from corrosion and primes the surface to improve the adhesion of subsequently applied protective or decorative coatings.

2. Discussion of Related Art

Conventional pre-treatment of metal surfaces is typically designed to protect the surfaces from corrosive attack of the environmental atmosphere for an extended period of time and to improve adhesion of subsequent coatings. The most widely used commercial methods of pre-treatment are the formation of phosphate and chromate conversion coatings, with the selection of the appropriate method usually depending on which of the two methods will provide better results in a particular case. Futther criteria for the selection of the treatment procedure to be employed include the coatings to be subsequently applied, the contemplated further treatment of the metal substrate, its size, and the quality specifications which must be met.

Heretofore, it has been common practice in the art to employ different types of coating processes for each kind of metal to be treated. While these different processes permit specific quality standards to be met for high-quality products, in practice these separate processes have the inherent serious drawback of requiring a great deal of space. Moreover, separate phosphating or chromating processes require the solutions or baths to be freshly prepared before use, so that unused solutions or baths have to be discarded or—if possible at all—to be stored and topped up by the addition of new chemicals for a renewed use. This is wasteful of both space and materials and is impractical on both economic and ecological grounds.

It is known from the prior art to provide metals, including composite metals, with a phosphate coating which protects the underlying metal from corrosion and improves the adhesion of subsequent coatings. Steel, galvanized metal, and aluminum are all routinely protectively coated by processes such as zinc phosphation. However, a determination of the operating of the pretreatment bath constitutes a problem when composite metals are to be pretreated. For example, the formation of an opaque coating on certain metals requires certain coating bath components to be employed which in turn renders coating of the other metals present more difficult, if not impossible. In order to obtain a phosphate coating meeting minimum requirements on aluminum, the addition of fluoride (for example in the form of acidic bifluorides, fluoroborate or fluorosilicate) to the phosphating bath is indispensable; this additive, however, adversely affects the coating quality on other metals present, such as electrogalvanized steel. In fluoride-free multimetal conversion coating processes, good protection from corrosion can be obtained on steel and galvanized metals; however, the results are not satisfactory on aluminum. Accordingly, on steel and galvanized steel the specifications of the German automotive industry for the quality class I (480 hours salt spray test; infiltration less than 2 mm) can be readily met in a fluoride-free process, whereas on aluminum they can not, and high-quality protectively coated composites of steel and aluminum are consequently difficult to obtain.

The protective pre-treatment of metal surfaces of steel, galvanized metal, and aluminum is also affected with "non-coating processes" wherein aqueous alkali or ammonium orthophosphate solutions containing surfactants are used. However, these processes only coat steel surfaces, with formation of mixed iron phosphates. Galvanized surfaces or aluminum surfaces treated with such solutions are only cleaned and degreased. Thus, the protection from corrosion is distinctly inferior to that effected by a zinc phosphate coating, and regularly barely meets the standards of the German automotive industry quality class II (240 hours salt spray test; infiltration less then 3 mm).

Meanwhile, today in all industrial fields to an increasing degree, surfaces are varnished and coated using powder processes which require the anticorrosive coatings obtained to be extremely thin films. Multimetals treated by these processes do not comply with standards for each metal to the same degree.

DESCRIPTION OF THE INVENTION

In the metal-working industry, particularly in the appliance and automotive industries, composite metals are being increasingly used. The term "composite metals" is understood herein to mean metal substrates having external surfaces comprising two or more different metals. The metals are often bonded to one another by welding, riveting, edging, adhesion-bonding and similar art-accepted methods. Composite metals within the scope of the invention include metal combinations of steel/aluminum; steel/hot-galvanized steel/aluminum; steel/electrogalvanized steel; steel/aluminum/electrogalvanized steel; and steel/leaded steel. Other metal combinations are also treatable by the process of the invention. The use of such composite metals to frequent owing to advantages obtained, particularly with respect to improvement of anticorrosive properties of the product, improvement of mechanical properties of the metal during shaping and use, increase of resistance to chemicals, and product aesthetics, especially for producing a surface having a definite appearance or gloss effect.

Composite metals according to the invention, similarly to neat steel surfaces, are generally pre-treated before subsequent opaque coatings are applied. Herein, "opaque coatings" are understood to be coatings predominantly (at least 50% by weight) organic materials which serve to protect the metal surface from damage and corrosion and to improve the visual appearance. Such organic coatings include paint and varnish systems of the type conventionally used to finish coat metal surfaces.

The invention provides a process for forming a protective coating for metal materials, including composite metal materials, which protects them from corrosion and improves adhesion of subsequent coatings. The process is suited for industrial application, i.e., it is sufficienty fast, operable under moderate reaction conditions, and permits different metals to be sequentially or simultaneously pretreated in the same coating bath as well as permitting composite metals to be protectively coated up to accepted standards in a single bath. The coating baths are formulated so that the bath components are deposited on the different metals to form thin films which meet the highest standards for corrosion protection and adhesion of subsequently applied coatings. The invention is particularly directed to the combined coating of aluminum and steel surfaces, which in the art is considered to be particularly difficult since steel surfaces are pronouncedly sensitive to bath poisons such as aluminum (III) ions, in small concentrations. Furthermore, due to the differences in electrochemical potentials in the presence of aluminum in a metal composite, deleterious effects on the coating result when prior art processes are employed.

The coating baths of the invention useful for composite metal protection according to this process comprise passivating aqueous acidic solutions containing molybdate ($MoO_4^{2-}$), chromium ($Cr^{3+}$), fluoride ($F^-$), phosphate ($PO_4^{3-}$), zinc ($Zn^{2+}$), and acetate ($CH_3COO^-$), each in defined concentrations. The baths are useful both on composite metals, and for pre-treating different metals in sequence or together in the same bath composition.

Other than in the operating examples, or where otherwise indicated, all numbers expressing quantities of ingredients or reaction conditions used herein are to be understood as modified in all instances by the term "about".

The invention provides a phosphating solution containing zinc and phosphate ions, and a process for coating metals with this solution comprising optionally cleaning the substrate metal and treating the optionally cleaned substrate metal with an aqueous acidic solution containing:

molybdate ions in an amount of from 0.01 to 10.0 g/l;
chromium (III) ions in an amount of from 0.01 to 10.0 g/l;
fluoride ions in an amount of from 0.01 to 10.0 g/l;
phosphate ions in an amount of from 0.01 to 10.0 g/l;
zinc ions in an amount of from 0.005 to 1.0 g/l; and
acetate ions in an amount of from 0.01 to 10.0 g/l.

The pH value of the aqueous solution is from 2.8 to 4.5, and preferably is from 3 to 3.5. At these pH values, most metal surfaces are optimally conditioned for deposition of the solution components.

In one embodiment of the invention, the phosphating solution contains molybdate ($MoO_4^{2-}$) in an amount of from 0.33 to 0.35 g/l; chromium ($Cr^{3+}$) in an amount of from 0.76 to 0.80 g/l; fluoride ($F^-$) in an amount of from 0.11 to 0.15 g/l; phosphate ($PO_4^{3-}$) in an amount of from 0.59 to 1.1 g/l; zinc $Zn^{2+}$) in an amount of from 0.094 to 0.11 g/l; and acetate ($CH_3CHOO^-$) in an amount of from 2.0 to 2.5 g/l. Baths of this composition provide markedly thin, fine conversion coatings having excellent properties meeting all standard quality requirements.

In another embodiment of the invention, zinc ($Zn^{2+}$) is partly substituted with calcium ($Ca^{2+}$) or manganese ($Mn^{2+}$) in a total amount of calcium and/or manganese of from 0.08 to 0.33 g/l; the calcium, manganese and zinc are present in the bath in a total concentration of from 0.090 to 0.35 g/l. The use of calcium or manganese may improve protection from corrosion and adhesion of opaque coatings, depending upon the substrate metal and final coating material.

In a further embodiment of the invention, the phosphating solutions additionally include customary additives such as accelerators for decreasing treatment time. Exemplary accelerators include sodium glycerophosphate and/or N-cyclohexanesulfamic acid, which act as accelerators or regulators and are present in the bath alone or in combination, usually in a total amount of from 0.1 to 5 g/l, and preferably in a total amount of from 0.5 to 2.0 g/l.

By the process according to the invention, it is possible to passivate a variety of non-aluminum surfaces, especially steel surfaces, with very good results, in the presence of aluminum or aluminum composites or alloys. The process is particularly useful for the passivation of composite metals, and more particularly for the passivation of composites comprising steel/aluminum; steel/hot-galvanized steel/aluminum; steel/galvanized steel; steel/aluminum/galvanized steel; and steel/leaded steel; or surfaces based on these metals.

In the first step of the process of the invention for applying protective coatings to discrete metals or composites thereof, the metals are usually subjected to an alkaline cleaning process in a known manner. Typically, the metal is treated with an aqueous cleaning solution adjusted to a high alkaline value with large amounts of alkali metal hydroxides for degreasing the metal surface and removing contaminations adhering to the surface. In order to prevent the components of the alkaline cleaning bath from being entrained and introduced into the acidic phosphating solution, after the alkaline cleaning the metal surfaces are generally rinsed with cold water, as by spraying, immersing, or combined spray-immersion procedures.

It is also possible to clean the substrate metals by including a surfactant in the phosphate coating bath of the invention in an amount sufficient to degrease and clean the metal surfaces to be treated. Many alkaline precleaners are known to the prior art, and these are generally useful for cleaning the metals or metal composites before treatment according to the invention. Surfactants employed in the phosphate coating baths are those compatible with the other constituents of the baths and, more specifically, are those stable at the acidic pH employed. In a particularly preferred embodiment, biologically degradable surfactants are used, such as ethoxylated and propoxylated $C_{12}$–$C_{14}$-fatty alcohols, such as those alkoxylated with, for example, 10 moles EO per mole alcohol, $C_1$–$C_{12}$-alkyl glycosides; and alkali metal salts of phosphate esters (for example Triton H66, Rohm & Haas, Frankfurt/Germany) Bath solutions containing such surfactants permit combined cleaning and passivation in a one step procedure.

The coating baths of the invention are applied to the metal surfaces to be treated by customary methods according to the prior art. These methods include spraying, immersion, or combined spray-immersion processes. Bath temperatures employed are generally within the range of from 35° to 40° C., which is significantly lower than temperature ranges employed in prior art phosphate coating processes (50° to 60° C.). This provides an energy-saving and economic operation.

The treatment periods are variable within a comparatively wide range. The process rapidly provides coatings which are often discernible within 3 seconds, particularly if accelerators are employed. According to the invention, treatment periods within the range of from 3 to 90 seconds are generally contemplated. These periods are significantly less than the treatment periods required for related prior art processes for the coating of metals (60 to 180 seconds). The shorter treatment periods contribute in an advantageous manner to the economics of the operation of the process, since a more rapid throughput of the substrate metal through the coating baths is attainable.

The coating solutions of the present invention are conveniently prepared as concentrates, suitably in containers of synthetic material (plastics) or of stainless steel. Such concentrates are more easily manufactured and shipped. The concentrates are diluted by the user with water, usually without addition of further materials, to provide a total concentration of bath components of about 2% by weight for most applications, with the individual components present in amounts as set forth supra. Alternatively, the concentrate is prepared without phosphoric acid, which is subsequently added by the user to the dilution. This procedure is particularly recommended if a long storage period is contemplated.

Treatment of the substrate metal with the phosphating solution is followed by rinsing the metal substrate with water, usually with fully de-salted water. Thereafter, the coated substrate metals are dried in a customary manner. Drying is readily done in ambient air, or at elevated temperature in an oven. In order to accelerate the drying procedure, the air in the drying oven may be circulated or replaced.

The process according to the invention for forming a protective coating protecting from corrosion and improving the adhesion for subsequently applied opaque coatings on the metal substrate has numerous advantages over related prior art processes. Thus, composite metals or individual units of different metals may be pre-treated together or one after another with no exchange of the bath or change in the bath composition required. In addition, it is possible to protectively coat steel and other metals in the presence of aluminum-containing materials. The coating process is advantageously carried out at a low temperature and within a short treatment time and provides thin coatings as required for modern coating processes.

The invention is further illustrated by way of the following examples.

EXAMPLE 1

A. Preparation of Coating Bath

A phosphating concentrate A was prepared by mixing the following components in a stainless steel container:

Water: 63.85 parts by weight
Chromium (III) acetate: 21.15 parts by weight
Sodium glycerophosphate: 5.0 parts by weight
Chromium (III) fluoride$\times 4H_2O$: 2.0 parts by weight
$H_3PO_4$ (75% solution): 4.87 parts by weight
ZnO: 0.13 parts by weight
Sodium molybdate: 3.0 parts by weight A 1% solution of the phosphating concentrate A contained:

Chromium (III): 0.38 g/l
Glycerophosphate: 0.39 g/l
Fluoride ($F^-$): 0.06 g/l
Phosphate ($PO_4^{3-}$): 0.36 g/l
Zinc ($Zn^{2+}$): 0.01 g/l
Molybdate ($MoO_4^{2-}$): 0.20 g/l
Acetate: 1.11 g/l In a similar container a surfactant concentrate B was prepared by mixing and stirring the following components:

$C_{8-12}$—Fatty alcohol ethoxylate (10EO): 20%
$C_{10}$—Alkylglycoside: 20%
Alkali metal salt of a phosphate ester: 60%
(Triton H66, Rohm & Haas, Frankfurt, Germany)

From the two concentrates a phosphating solution for the spray treatment of metal sheets was prepared by mixing the concentrates A and B in water to provide a coating solution containing 10.0 g/l of the concentrate A and 3.0 g/l of the concentrate B. The pH value of the solution was 3.5.

B. Coating of Metals

The phosphating solution of Example 1A was used to coat steel sheets, hot-galvanized sheets, and aluminum sheets of the quality 99.5. The sheets were cleaned, degreased and passivated together in one operation by immersing each sheet into the bath at a temperature of 40° C. for 90 seconds.

The metal sheets were then rinsed with cold water for 30 seconds and after-rinsed with fully de-salted water for 10 seconds. Finally, the sheets were dried in an oven at 85° C. for 5 minutes.

The sheets thus passivated were coated with a PUR varnish manufactured by Fa. Weilburger Lackfabrik, (Weilburg, Germany).

A "Bundeswehraufbau" (a construction in accordance with German Federal Armed Forces Standards) was formed from these sheets according to Standard Tl 8010-002. The sheets had a total layer thickness of from 85 to 100 nm. The sheets were then given a single cut in accordance with DIN 53167* and subjected to a salt spray test according to DIN 50021* for a period lasting 480 hours.

| Evaluation according to DIN 53167/DIN 53209* | | |
|---|---|---|
| Infiltration: | Cold-rolled steel | ≦3 mm |
| | Hot-galvanized steel | ≦3 mm |
| | Aluminum | 0 |
| Degree of Blisters: | Cold-rolled steel | m0/g0 |
| | Hot-galvanized steel | m0/g0 |
| | Aluminum | m0/g0 |

COMPARATIVE EXAMPLE 1

Cold-rolled steel sheets, hot-galvanized steel sheets and aluminum sheets of the quality 99,5 were cleaned and degreased in an alkaline solution in a conventional spraying process at 55° C. for 90 seconds.

The sheets were then rinsed with cold water for 30 seconds and after-rinsed with fully de-salted water for 10 seconds. The sheets were subsequently dried by blowing with air. The sheets thus pre-treated were coated with the PUR varnish used in Example 1B. A Bundeswehraufbau (TL 8010-0002) was fabricated from the metal sheets to have a total layer thickness of from 85 to 100 mm, comparable to Example 1B.

The sheets were then furnished with a single cut in accordance with DIN 53167* and subjected to a salt spray test according to DIN 50021* for a period lasting 480 hours.

| Evaluation according to DIN 53167/DIN 53209* | | |
|---|---|---|
| Infiltration: | Cold-rolled steel | >25 mm |
| | Hot-galvanized steel | >15 mm |
| | Aluminum 99,5 | >5 mm |
| Degree of Blisters: | Cold-rolled steel | m5/g1 |
| | Hot-galvanized steel | m2/g1 |
| | Aluminum 99,5 | m1/g1 |

EXAMPLE 2

A. Preparation of Coating Bath

A phosphating concentrate A comparable to that of Example 1A was prepared by mixing the following compounds in a stainless steel container:

Water: 63.85 parts by weight
Chromium (III) acetate: 21.15 parts by weight
Sodium glycerophosphate: 5.0 parts by weight
Chromium (III) fluoride$\times 4H_2O$: 2.0 parts by weight
$H_3PO_4$ (75% solution): 4.87 parts by weight
ZnO: 0.13 parts by weight
Sodium molybdate: 3.0 parts by weight From this concentrate A, a passivating bath for use in a spray treatment was prepared by diluting the concentrate A with water to a concentration of 10 g/l.

The total acid value was 13, as determined by tritation of a bath sample of 100 ml with 0.1N sodium hydroxide solution to a pH of 8.5 (as measured with a pH-meter).

The free acid value was 1.3, as determined by titration of a bath sample of 100 ml with 0.1N sodium hydroxide solution to a pH of 4.0 (as measured with a pH-meter).

B. Coating of Metals

Cold-rolled steel sheets, hot-galvanized steel sheets and aluminum sheets of the quality 99.5 together were subjected to the following process steps:

The sheets were first conventionally cleaned and degreased with an alkaline cleaning agent by a spraying procedure at 55° C. for 60 seconds and rinsed with cold water for 30 seconds. The sheets were then treated with the passivating solution of Example 2A by spraying at 30° C., 35° C., or 40° C. for treatment periods of 30, 60, or 90 seconds. The sheets were then rinsed with cold water for 30 seconds and after-rinsed for 10 seconds with fully desalted water. Finally the sheets were dried in an oven at 85° C. for 5 minutes.

The sheets thus passivated were coated with the PUR varnish of the Wellburger Lackfabrik used in Example 1B. This was followed by forming a Bundeswehraufbau according to Example 1 with a total layer thickness of from 85 to 100 mm.

The sheets were furnished with a single cut in accordance with DIN 53167* and subjected to a salt spray test according to DIN 50021* for a period lasting 480 hours. The evaluation was made according to DIN 53167*/DIN 53209*: the results are apparent from the following Tables 1 to 3.

TABLE 1

| Kind of Material | Treatment Temperature (°C.) | Treatment Time (seconds) | Infiltration (mm) | Degree of Blisters |
|---|---|---|---|---|
| Cold-rolled steel | 30 | 30 | 2.0–2.5 | m0/g0 |
| Hot-galvanized steel | 30 | 30 | 2.0–3.0 | m0/g0 |
| Aluminum | 30 | 30 | 0 | m0/g0 |
| Cold-rolled steel | 35 | 30 | 2.0–2.4 | m0/g0 |
| Hot-galvanized steel | 35 | 30 | 2.2–2.8 | m0/g0 |
| Aluminum | 35 | 30 | 0 | m0/g0 |
| Cold-rolled steel | 40 | 30 | 2.1–2.3 | m0/g0 |
| Hot-galvanized steel | 40 | 30 | 2.3–2.7 | m0/g0 |
| Aluminum | 40 | 30 | 0 | m0/g0 |

TABLE 2

| Kind of Material | Treatment Temperature (°C.) | Treatment Time (seconds) | Infiltration (mm) | Degree of Blisters |
|---|---|---|---|---|
| Cold-rolled steel | 30 | 60 | 2.1–2.4 | m0/g0 |
| Hot-galvanized steel | 30 | 60 | 2.2–2.8 | m0/g0 |
| Aluminum | 30 | 60 | 0 | m0/g0 |
| Cold-rolled steel | 35 | 60 | 1.8–2.4 | m0/g0 |
| Hot-galvanized steel | 35 | 60 | 2.2–2.8 | m0/g0 |
| Aluminum | 35 | 60 | 0 | m0/g0 |
| Cold-rolled steel | 40 | 60 | 2.0–2.3 | m0/g0 |
| Hot-galvanized steel | 40 | 60 | 2.1–2.4 | m0/g0 |
| Aluminum | 40 | 60 | 0 | m0/g0 |

TABLE 3

| Kind of Material | Treatment Temperature (°C.) | Treatment Time (seconds) | Infiltration (mm) | Degree of Blisters |
|---|---|---|---|---|
| Cold-rolled steel | 30 | 90 | 2.1–2.4 | m0/g0 |
| Hot-galvanized steel | 30 | 90 | 2.0–2.8 | m0/g0 |
| Aluminum | 30 | 90 | 0 | m0/g0 |
| Cold-rolled steel | 35 | 90 | 2.0–2.4 | m0/g0 |
| Hot-galvanized steel | 35 | 90 | 2.3–2.5 | m0/g0 |
| Aluminum | 35 | 90 | 0 | m0/g0 |
| Cold-rolled steel | 40 | 90 | 1.8–2.6 | m0/g0 |
| Hot-galvanized steel | 40 | 90 | 2.1–2.4 | m0/g0 |
| Aluminum | 40 | 90 | 0 | m0/g0 |

EXAMPLE 3

A. Preparation of Coating Solution

A phosphating concentrate A was prepared by mixing the following components in a stainless steel container:

Water: 63.85 parts by weight
Chromium (III) acetate: 21.15 parts by weight
N-Cyclohexanesulfamic acid: 5.0 parts by weight
Chromium (III) fluoride$\times 4H_{20}$: 2.0 parts by weight
$H_3PO_4$ (75% solution): 4.67 parts by weight
ZnO: 0.13 parts by weight
$CaCO_3$: 0.195 parts by weight
Sodium molybdate: 3.0 parts by weight A passivating solution for use in a spray treatment was prepared by diluting the concentrate A with water to a concentration of 10 g/l.

A 1% solution thus prepared of the above-described concentrate contained:

Chromium (III): 0.38 g/l
Acetate ($CH_3COO^-$): 1.11 g/l
N-Cyclohexanesulfamic acid: 0.50 g/l
Fluoride ($F^-$): 0.06 g/l
Phosphate ($PO_4^{3-}$): 0.34 g/l Zinc ($Zn^{2+}$): 0.06 g/l
Calcium ($Ca^{2+}$): 0.008 g/l
Molybdate ($MoO_4^{2-}$): 0.20 g/l The total acid value of the concentrate was 13, as determined by titration of a bath sample of 100 ml with 0.1N sodium hydroxide solution to a pH of 8.5 (as measured with a pH-meter).

The free acid value of the concentrate was 1.3, as determined by titration of a bath sample of 100 ml with 0.1N sodium hydroxide solution to a pH of 4.0 (as measured with a pH-meter).

B. Coating of Metals

Cold-rolled steel sheets, galvanized steel sheets and aluminum sheets of the quality 99.5 were together subjected to the following process steps:

The sheets were first conventionally cleaned and degreased with an alkaline cleaning agent by a spraying procedure at 55° C. for 60 seconds and then rinsed with cold water for 30 seconds. The sheets were then treated with the above-described passivating solution by spraying at 38° C. for a treatment period of 30 seconds. The sheets were then rinsed with cold water for 30 seconds and after-rinsed for 10 seconds with fully de-salted water. Finally the sheets were dried in an oven at 85° C. for 5 minutes.

The sheets thus passivated were cathodically dip-coated with an electro-dipcoat composition (product identification, available from Herberts, Wuppertal, Germany). Then the sheets were each cut once in accordance with DIN 53167* and subjected to a salt spray test according to DIN 50021* for a period of 480 hours.

| Evaluation according to DIN 53167/DIN 53209* | | |
|---|---|---|
| Infiltration: | Cold-rolled steel | ≦3 mm |
| | Hot-galvanized steel | ≦3 mm |
| | Aluminum | 0 |
| Degree of Blisters: | Cold-rolled steel | m0/g0 |
| | Hot-galvanized steel | m0/g0 |
| | Aluminum | m0/g0 |

EXAMPLE 4

A. Preparation of Coating Bath

An immersion coating bath was prepared by diluting the concentrate A of Example 3 with water to a concentration of 20 g/l (twice the concentration of the passivating solution of Example 3).

The pH of the solution was 3.3.

The total acid value was 25, as determined by titration of a bath sample of 100 ml with 0.1N sodium hydroxide solution to a pH of 8.5 (as measured with a pH-meter). The free acid value was 2.5, as determined by titration of a bath sample of 100 ml with 0.1N sodium hydroxide solution to a pH of 4.0 (as measured with a pH-meter).

B. Coating of Metals

Cold-rolled steel sheets, aluminum sheets and hot-galvanized steel sheets were subjected together to the following process steps:

The sheets were first conventionally cleaned and degreased with an alkaline cleaning agent by dipping at 60° C. for 5 minutes. Then they were rinsed in cold water for 2 minutes. This was followed by dip-treatment with the coating bath from Example 4A at 38° C. for a treatment period of 2 minutes. The sheets were then rinsed in cold water for 2 minutes and after-rinsed for 10 seconds in fully de-salted water. Finally the sheets were dried in an oven at 85° C. for 5 minutes. The thus passivated metal sheets were coated with an epoxide powder (product identification BASF AG, Ludwigshafen, Germany). Then the sheets were once-cut in accordance with DIN 53167* and subjected to the salt spray test according to DIN 50021* for a period of 480 hours.

| Evaluation according to DIN 53167/DIN 53209* | | |
|---|---|---|
| Infiltration: | Cold-rolled steel | ≦3 mm |
| | Hot-galvanized steel | ≦3 mm |
| | Aluminum 99.5 | 0 |
| Degree of Blisters: | Cold-rolled steel | m0/g0 |
| | Hot-galvanized steel | m0/g0 |
| | Aluminum 99.5 | m0/g0 |

EXAMPLE 5

A. Preparation of Coating Bath

The concentrate of Example 3A was diluted with water to a concentration of 15 g/l for a phosphating bath for spray treatment. The concentration of the bath batch was one and a half times that of Example 3. The total acid value was 19, as determined by titration of a bath sample of 100 ml with 0.1N sodium hydroxide solution to a pH of 8.5 (as measured with a pH-meter). The free acid value was 1.9, as determined by titration of a bath sample of 100 ml with 0.1N sodium hydroxide solution to a pH of 4.0 (as measured with a pH-meter).

B. Coating of Metals

Leaded steel sheets were subjected to the following process steps:

The sheets were first conventionally cleaned and degreased with an alkaline cleaning agent by spraying at 55° C. for 60 seconds. They were then rinsed with cold water for 30 seconds. The sheets were then coated by spray treatment with the coating bath of Example 5A at 38° C. for a treatment period of 60 seconds. The sheets were then rinsed in cold water for 30 seconds and after-rinsed for 10 seconds with fully de-salted water. Finally the sheets were dried in an oven at 85° C. for 5 minutes.

The thus passivated sheets were coated with a PUR varnish (available from Winkelmann, Dortmund, Germany). The sheets were cut once in accordance with DIN 53167* and subjected to the salt spray test according to DIN 50021* for a period lasting 480 hours.

| Evaluation according to DIN 53167/DIN 53209* | |
|---|---|
| Infiltration: | <2 mm |
| Degree of Blisters | m0/g0 |

COMPARTIVE EXAMPLE 2

Leaded steel sheets were first conventionally cleaned and degreased in an alkaline solution at 55° C. for 60 seconds as in Example 5B. They were then rinsed with cold water for 30 seconds and after-rinsed for 10 seconds with fully de-salted water. The rinsed sheets were dried by blowing with compressed air. The pretreated sheets were coated with a PUR varnish (available from Weilburger Lackfabrik, Weilburg, Germany). Then the sheets were cut once in accordance with DIN 53167* and subjected to the salt spray test according to DIN 50021* for a period lasting 480 hours.

| Evaluation according to DIN 53167/DIN 53209* | |
|---|---|
| Infiltration: | 22 mm |
| Degree of Blisters: | m3/g5 |

*DIN refers throughout to official Federal Republic of Germany Industrial Norms set by the Federal government.

Note: In all the Examples 1-5, the phosphoric acid is alternatively added to the diluted phosphating solutions to the appropriate concentration, rather than to the concentrates.

We claim:

1. A process for forming a protective coating on a metal substrate for protecting the metal from corrosion and priming the metal to improve adhesion of subsequent coatings, comprising treating the metal substrate for about 3 to about 90 seconds with an aqueous acidic phosphating solution having a pH of from about 2.8 to about 4.5 and consisting essentially of:
   - molybdate ($MoO_4^{2-}$) ions in an amount of from about 0.01 to 10.0 g/l;
   - chromium (III) ions in an amount of from about 0.01 to 10.0 g/l;
   - fluoride ($F^-$) ions in an amount of from about 0.01 to 10.0 g/l;
   - phosphate ($PO_4^{3-}$) ions in an amount of from about 0.01 to 10.0 g/l;
   - zinc ($Zn^{2+}$) ions in an amount of from about 0.005 to 1.0 g/l; and
   - acetate ($CH_3CO_2^-$) ions in an amount of from about 0.01 to 10.0 g/l, to protectively coat the substrate metal surface.

2. The process of claim 1, including cleaning said metal surface prior to said treating step.

3. The process of claim 1, wherein the pH is from about 3.0 to 3.5.

4. The process of claim 1, wherein the aqueous acidic phosphating solution contains molybdate ion in an amount of from about 0.33 to 0.35 g/l.

5. The process of claim 1, wherein the aqueous acidic phosphating solution contains chromium ion in an amount of from about 0.76 to 0.80 g/l.

6. The process of claim 1, wherein the aqueous acidic phosphating solution contains fluoride ion in an amount of from about 0.11 to 0.15 g/l.

7. The process of claim 1, wherein the aqueous acidic phosphating solution contains phosphate ion in an amount of from about 0.59 to 1.1 g/l.

8. The process of claim 1, wherein the aqueous phosphating solution contains zinc ion in an amount of from about 0.094 to 0.11 g/l.

9. The process of claim 1, wherein the aqueous acidic phosphating solution contains acetate ion in an amount of from about 2.0 to 2.5 g/l.

10. The process of claim 1, wherein the aqueous acidic phosphating solution additionally contains an accelerator selected from sodium glycerophosphate and N-cyclohexanesulfamic acid in a total accelerator amount of from about 0.1 to 5.0 g/l.

11. The process of claim 10, wherein the acelerator is present in an amount of from about 0.5 to 2.0 g/l.

12. The process of claim 1, wherein the aqueous acidic phosphating solution further includes calcium ($Ca^{2+}$) ion or manganese ($Mn^{2+}$) ion or both in a total amount of calcium and manganese of from about 0.08 to 0.33 g/l, and a total amount of calcium ion, manganese ion and zinc ion of from about 0.090 to 0.35 g/l.

13. The process of claim 1, wherein the metal substrate comprises a composite metal surface.

14. The process of claim 1, wherein the metal substrate comprises a uniform metal surface.

15. The process of claim 13, wherein the composite metal surface includes aluminum, or steel, or both.

16. The process of claim 13, wherein the composite metal surface includes steel and aluminum; or steel, hot-galvanized steel, and aluminum; or steel and electrogalvanized steel; or steel, aluminum, and electrogalvanized steel; or steel and leaded steel.

17. The process of claim 1, wherein the metal substrate is treated with the aqueous acidic phosphating solution at a temperature of from about 35° C. to 40° C.

18. The process of claim 1, wherein the metal substrate is treated with the aqueous acidic phosphating solution by spraying, immersion, or a combination of spraying and immersion.

19. The process of claim 1, wherein the metal substrate is thereafter rinsed with fully de-salted water.

20. The process of claim 1, wherein the metal substrate is air-dried or oven-dried at elevated temperature with air circulation.

21. The process of claim 1, wherein the aqueous acidic phosphating solution additionally contains a surfactant compatible with the solution components in an amount sufficient to clean and degrease the metal substrate surface.

22. The process of claim 21, wherein the surfactant is a biologically degradable surfactant selected from the group consisting of ethoxylated and propoxylated fatty alcohols, alkylglycosides, and alkali metal salts of phosphate esters.

23. A phosphating solution for priming and protectively coating a metal substrate consisting essentially of an acidic aqueous solution of:
   - molybdate ($MoO_4^{2-}$) ions in an amount of from about 0.01 to 10.0 g/l;
   - chromium (III) ions in an amount of from about 0.01 to 10.0 g/l;
   - fluoride ($F^-$) ions in an amount of from about 0.01 to 10.0 g/l;
   - phosphate ($PO_4^{3-}$) ions in an amount of from about 0.01 to 10.0 g/l;
   - zinc ($Zn^{2+}$) ions in an amount of from about 0.005 to 1.0 g/l; and
   - acetate ($CH_3CO_2^-$) ions in an amount of from about 0.01 to 10.0 g/l; said solution having a pH of from about 2.8 to about 4.5.

24. The phosphating solution of claim 23, wherein
   - molybdate ion is present in an amount of from about 0.33 to 0.35 g/l;
   - chromium ion is present in an amount of from about 0.76 to 0.80 g/l;
   - fluoride ion is present in an amount of from about 0.11 to 0.15 g/l;
   - phosphate ion is present in an amount of from about 0.59 to 1.1 g/l;
   - zinc ion is present in an amount of from about 0.094 to 0.11 g/l; and
   - acetate ion is present in an amount of from about 2.0 to 2.5 g/l.

25. A concentrated aqueous acetic solution which upon dilution with a controlled quantity of water produces the phosphating solution of claim 23.

26. A concentrated aqueous acidic solution which upon dilution with a controlled quantity of water produces the phosphating solution of claim 24.

* * * * *